US006270410B1

(12) United States Patent
DeMar et al.

(10) Patent No.: US 6,270,410 B1
(45) **Date of Patent: *Aug. 7, 2001**

(54) REMOTE CONTROLLED SLOT MACHINES

(76) Inventors: Michael DeMar, 1527 Rachel La., Buffalo Grove, IL (US) 60089; Piotr Sasinowski, 2543 Shoal Creek Ct., Riverwoods, IL (US) 60015

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/248,014

(22) Filed: Feb. 10, 1999

(51) Int. Cl.[7] ..... A63F 9/22

(52) U.S. Cl. ..... 463/20; 463/42; 273/148 B; 273/143 R

(58) Field of Search ..... 463/20, 39, 40, 463/42, 11–13, 25, 16, 36–37; 273/292, 293, 143 R, 139, 138.1, 138.2; 700/91–93

(56) References Cited

U.S. PATENT DOCUMENTS

D. 363,956 * 11/1995 Mathews ..... D12/48
4,403,777 * 9/1983 Del Principe et al. ..... 463/1
4,799,683 * 1/1989 Bruner, Jr. ..... 463/31
5,113,990 * 5/1992 Gabrius et al. ..... 194/206
5,605,504 * 2/1997 Huang ..... 463/22
5,611,730 * 3/1997 Weiss ..... 463/20
5,678,886 * 10/1997 Infanti ..... 297/344
5,984,782 * 11/1999 Inoue ..... 463/20
6,012,983 * 1/2000 Walker et al. ..... 463/20
6,019,283 * 2/2000 Lucero ..... 235/380

* cited by examiner

*Primary Examiner*—Mark Sager
(74) *Attorney, Agent, or Firm*—Welsh & Katz, Ltd.; Thomas W. Tolpin

(57) ABSTRACT

A special gaming system is provided with a portable controller comprising a remote control to remotely play a game on a slot machine. The remote control can be a battery-operated remote control, a cable-connected hand-held remote control, or a movable laptop keyboard, which is hard wired to the slot machine. Advantageously, the portable controller can simultaneously operate two or three slot machines to enhance the entertainment of customers. In the preferred form, the slot machine has a display to view the game and a coin-input slot to receive one or more coins to activate the game. The slot machine can also have at least one button and/or a manual pull arm to play the game.

9 Claims, 3 Drawing Sheets

REMOTE CONTROLLED SLOT MACHINES

BACKGROUND OF THE INVENTION

This invention pertains to gaming systems and, more particularly, to slot machines.

Over the years numerous gaming systems and gambling devices have been developed. Gaming systems and gambling devices are a very popular form of entertainment. Early slot machines had a mechanical pull arm which rotated reels (wheels) through a series of springs, levels, pulleys, toggles, and/or cams. These highly popular slot machines became affectionately known as "one arm bandits". Mechanical reels have indicia or symbols on their edges. The reels are set into rotation and stop at location corresponding to either a winning or losing combination. Historically, mechanical reels were stopped by a braking device, such as an indexing wheel fixed to each reel having indexing grooves into which a pin or a tripping arm assembly entered randomly. The tripping arm assembly included ratchets and pawls, as well as a springs which timed out to release the pins and stop the rotation of the reels in sequence. Advantageously, one arm bandits were developed with slots into which coins were inserted to activate the slot machine. One arm bandits were also provided with chutes from which coins were discharged into a cup, bucket, tray, or other receptacle.

In order to operate the one arm bandits, the mechanical lever was manually pulled forwardly and downwardly to rotate the reels. If the reels displayed identical symbols, such as cherries, oranges, etc., the game would be won and the one arm bandit would dispense one or more coins in accordance with established odds and the rules of the game.

In the mechanically controlled reel gaming machine, the starting and stopping of the reel rotation occurred substantially in random fashion after the handle was pulled. The particular stopping position of the reels and score was effected on a probability basis. After the reels were stopped, the stopped position was detected to determine whether a payout was to occur. The hit frequency or probability of a win was based on the laws of probability.

The payout odds and amount paid out can only be increased if the size of the mechanical reels were changed, i.e., made larger, to increase the number of stopping positions and the number of symbols displayed, if the number of reels remained constant. The number of mechanical reels can also be increased to increase the odds and payout by changing the number of wiring combinations. The lowest probability or maximum odds of a payout for such machines, is a function of the number of reels and the number of stop positions on each reel.

Many senior citizens and handicap persons, as well as repeat players and dedicated gamblers, have found that repeatedly pulling the arm of the one aim bandit can be tiresome and often difficult for some people. To alleviate this problem, one arm bandits and other slot machines have been equipped with an electronic push buttons which can be depressed by the touch of a finger to rotate the reels.

Subsequently, in some slot machine mechanical reels have been replaced by simulated electronic reels. These developments involving electronic slot machines utilize the probability on reel position selection resulting from computerized random number generators with video simulated displays of the reels.

Many players enjoy playing two or three one arm bandits or slot machines at the same time. Furthermore, many players would prefer to sit back comfortably on a stool or a chair at a location three or four feet or more away from the slot machine, much like watching a television. Conventional one arm bandits and other slot machines do not readily accommodate these desires of many players.

It is, therefore, desirable to provide an improved gaming system which overcomes most, if not all, of the preceding difficulties.

SUMMARY OF THE INVENTION

An improved gaming system is provided which is fun, exciting, and easy-to-use. Advantageously, the novel gaming system readily allows a single player to simultaneously play two or three slot machines. Significantly, the special gaming system also allows customers to remotely control the games in the slot machines from a comfortable distance away from the slot machines while standing or reclining, or otherwise sitting, in a chair, stool, etc.

In the preferred from, the slot machine of the gaming system has a display to view the game and a coin input slot to receive a coin(s) which activates the game. The slot machine has at least one button to play the game and a coin-output receptacle in which coins are dispensed upon payout of the game.

The gaming system further features a portable controller which is operatively associated with and spaced from the slot machine to remotely play the game on the slot machine. Preferably, the controller has at least one button and, most preferably, a set of buttons, to remotely play the game on the slot machine. The controller can also have a cash out button to remotely discharge collected coins in the slot machine into the coin-output receptacle on payout of the game. In one form, the controller is hardwired to the slot machine, such as through a metal braided cable or by electric wires. In another form, the controller comprises a battery-operated hand-held controller and, most preferably, a light weight remote control. In a further form, the controller comprises a laptop keyboard hard wired or remotely connected to the slot machine. The controller can also have a card slot to receive a credit card or debit card, such as a Visa® brand credit card, Mastercard® brand credit card, American Express® brand credit card, bank card, or casino card, in order to activate the slot machine. The slot machine can further have a bill slot to receive paper currency which activates the game.

The preferred slot machine also features a manual pull arm, as well as many other features, to enhance enjoyment, entertainment and play of the game. Other features are provided to enhance security, safety, and integrity of the game.

A more detailed explanation of the invention is provided in the following description and appended claims taken in conjunction with the accompanying drawings.

DETAILED DESCRIPTION OF THE PREFERRED EMBODIMENTS

Figure 1:
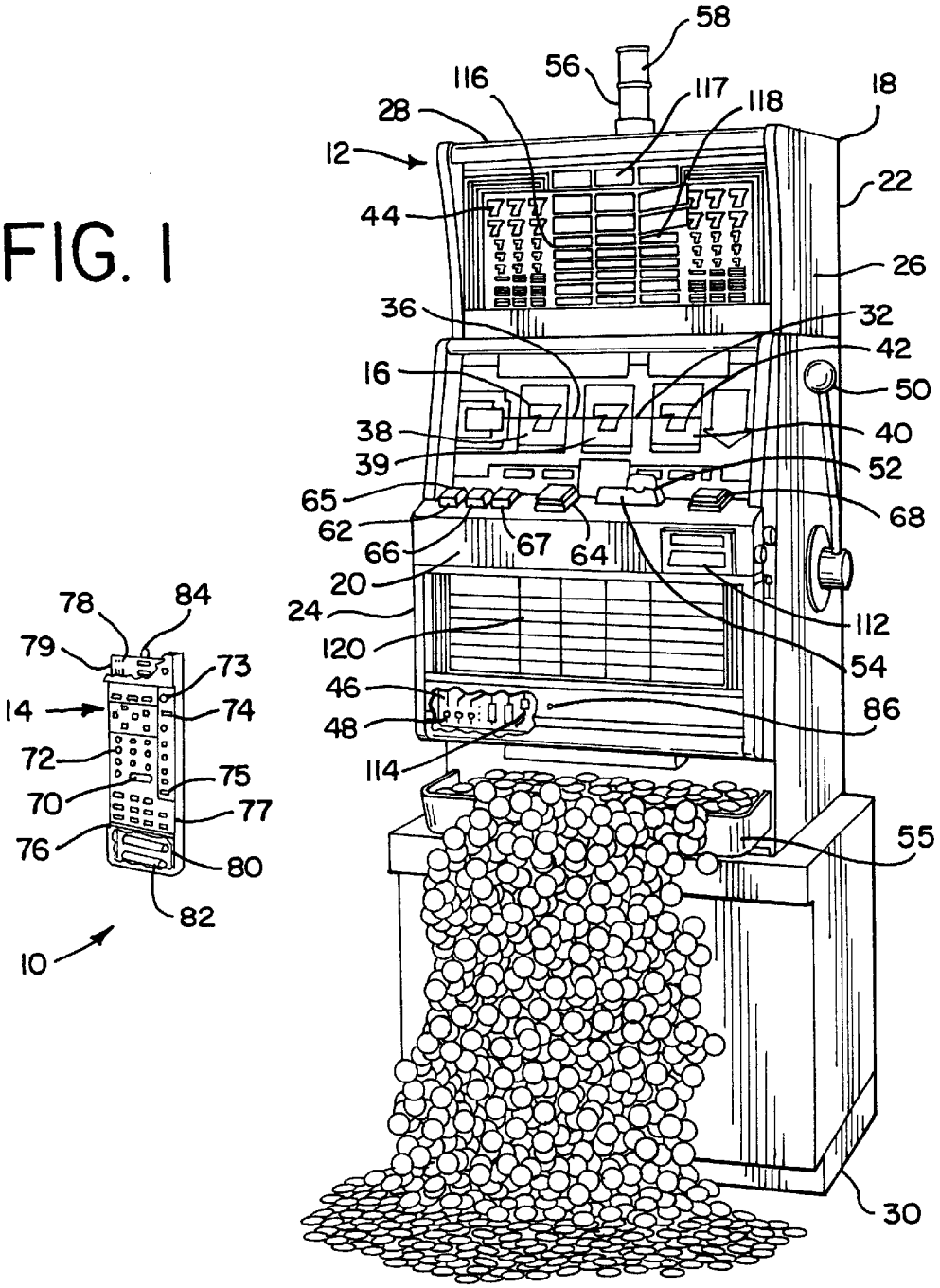
FIG. 1 is a fragmentary perspective view of a gaming system with a slot machine and battery operated remote control in accordance with principles of the present invention.

A user-friendly entertainment gaming system 10 (FIG. 1) comprises an attractive exciting slot machine 12, such as an improved one arm bandit, and a portable movable remote control 14 which provides a controller that accommodates remote control of the game 16 on the slot machine. Advantageously, the remote control can also simultaneously control two, three or more similar slot machines, if desired to do so by the player.

The slot machine has a slot machine-housing 18 (FIG. 1) which provides a casing made of metal or impact-resistant plastic. The slot machine-housing has a front 20, back 22, sides 24 and 26, a top 28, and a bottom 30. A transparent display screen 32 comprising a display window made of impact-resistant plastic or glass is provided in the front of the housing to display the game. The display screen can have a single horizontal pay line 36 or a criss-cross pattern of multiple play lines. Preferably, the game comprises at least three reels (wheels) 38–40 or simulated reels. The reels can have indicia 42 comprising symbols, such as: 7's, bells, cherries, stars, bars, plums, oranges, lemons, watermelons, wild symbols, bonus symbols, jack pot multipliers, etc. If desired, the slot machine can comprise a progressive jackpot 44 and the game can comprise a two or three coin multiple game.

Positioned within the interior of slot machine-housing is an electronic device 46 (FIG. 1), such as a microprocessor, computer chip, or circuit board which contains an electronic control circuit 48 to rotate or simulate the rotation of the reels, as well operate other components and parts of the slot machine as described hereinafter. A mechanical lever 50 comprising a manual pull arm can be provided. The mechanical lever extends laterally outwardly of the housing and can be connected to the electronic circuit and electronic device to spin the reels.

The slot machine also has a coin-input slot 52 (FIG. 1) with a coin chute 54 in the housing to receive one or more metal coins to activate the game. The slot machine can be programmed to receive one or more desired type of coins, such as, a token, nickel, dime, quarter, half dollar, or other minted coins representing legal tender of the U.S. or foreign governments. A coin-output receptacle 55 which comprises a metal trough, tray, container, or bucket, is located in the lower portion of the housing to receive metal coins upon payout of the game. One or more indicator lights 56 and 58 can extend above the top of housing. Indicator lights are connected to the electronic circuit to signal a visual alarm when the jackpot has been achieved or if the slot machine has been tilted or tampered with or for other situations, as desired.

The slot machine can also have set of buttons 62 (FIG. 1) which can be positioned below the display screen and above the coin-output receptacle. Desirably, the buttons on the slot machine include at least one play or spin button 64 which is connected to the electronic circuit to spin the reels when the play button is depressed by the player's finger. The button of the slot machine can also include: a change button 65, a cashout payout button 66, a credit button 67, and a multiple spin button 68 or maximum spin button. The spin button can play the credits chosen by the credits button. The multiple spin button is connected to the electronic circuit and can spin the reels automatically for continuous games until the credits are depleted without the need to press the button for each game. The credits can be displayed on the display screen.

For ease of play, the portable hand-held remote control 14 (FIG. 1) has at least one play or spin button 70 and preferably an array, set or series of manually depressible finger-touch play or spin buttons 72, which emit a signal when depressed (pushed) to the electronic circuit in the slot machine to spin the reels from a remote location spaced comfortably away from the display screen of the slot machine, such as on a comfortable chair or stool. The buttons of the remote control can include: a cash payout button 73, a credit button 74 and a multiple spin button 75. The cash payout button when depressed, can cause coins to be dispensed and discharged coins from the chute into the coin-output receptacle of the slot machine upon winning and payout of the game. The spin button can play the credits chosen by the credits button. The multiple spin button is operatively connected to remote control circuit and signals the electronic circuit of the slot machine to spin the reels automatically for continuous games until the credits are depleted without the need to press the button for each game. The credits can be displayed on the display screen. The remote control can further have a card slot 76 to receive a credit card to activate the game. The remote control can also include a plastic insulating remote control housing 77 with an interior containing a remote control circuit 78 on a substrate 79, such as a circuit board or computer chip. At lease part of the circuit in the remote control can be similar to part of the electronic circuit in the slot machine.

In FIG. 1, the portable remote control 14 is energized by one or more batteries 80 and provides a battery-operated hand-held remote control 82. A signaling light 84, such as a light emitting diode (LED), extends from the top of the battery-operated remote control, and is connected to the remote control circuit. When a button is pushed on the remote control visual signals comprising electrical pulses are generated and emitted by the signaling light, which are transmitted to a receptor 86, such as receptor light (lamp) on the front of the slot machine, when the remote control and signaling, light are aimed towards the receptor, to remotely actuate and control the slot machine.

Figure 2:
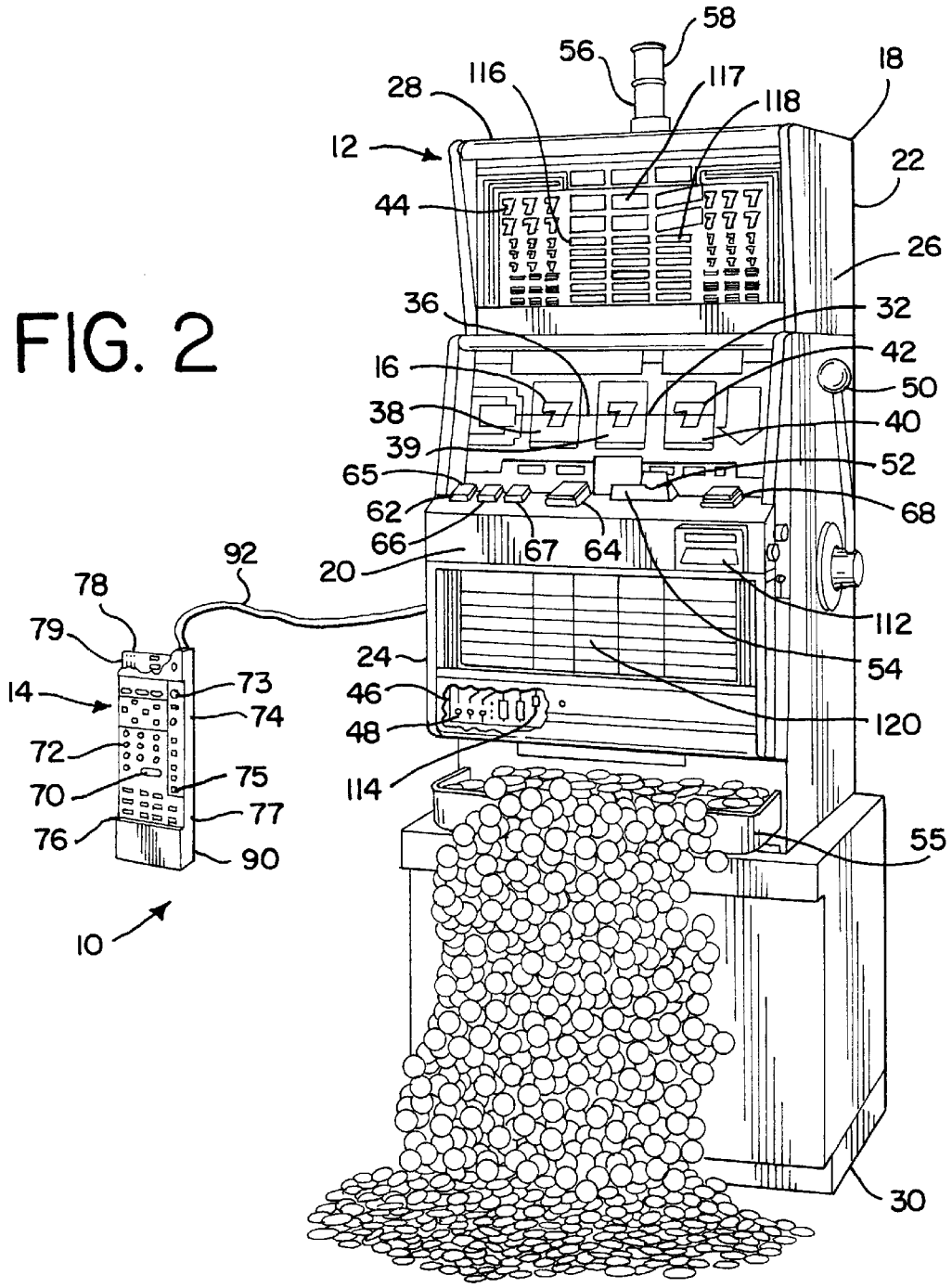
FIG. 2 is a fragmentary perspective view of a remote control hard wired to the slot machine.

In FIG. 2, the portable remote control comprises a portable cable-connected hand-held remote control 90 which is hard wired to the slot machine by a metal braided cable 92 containing wires that extend between and connect the remote control to the electronic circuit in the slot machine. The remote control of FIG. 2 can have buttons, circuitry, components and features similar to the remote control of FIG. 1. The remote control of FIG. 2 operates in a manner similar to the remote control of FIG. 1, although a signaling light may not be necessary, since the electrical pulses and signals generated and emitted by the remote control of FIG. 2 are transmitted to the circuit of the slot machine via the cable (wires) when a button on the remote control is pressed to remotely actuate and control the slot machine.

Figure 3:
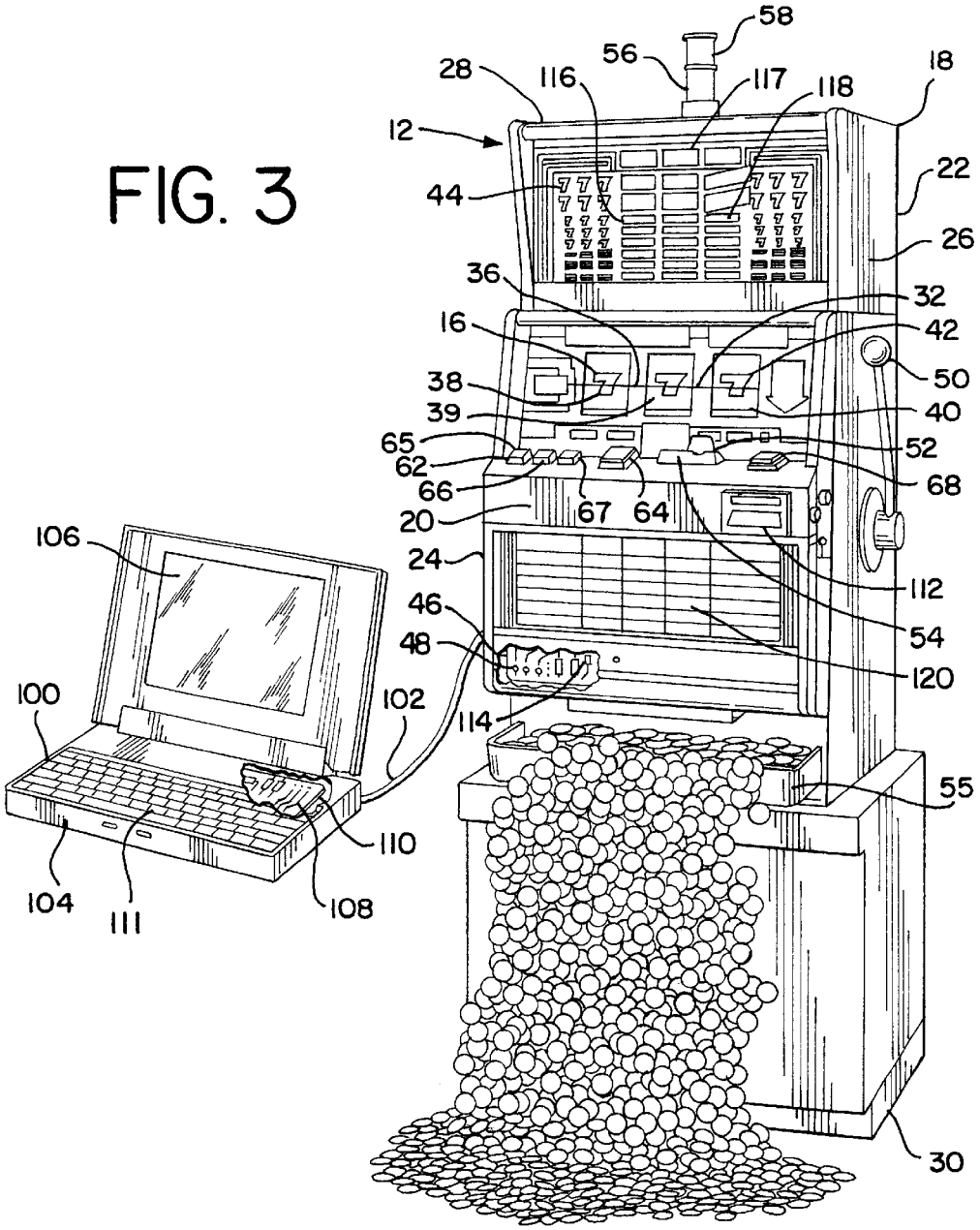
FIG. 3 is a fragmentary perspective view a remote control-laptop keyboard hard wired to the slot machine.

In FIG. 3, the portable remote control comprises a movable laptop keyboard 100 which can be hard wired to the slot machine by wires 102 that extend between and connect the laptop keyboard to the electronic circuits in the slot machine. The laptop keyboard can also be accessible to the slot machine via the internet through a modem or a portable or remote phone connection. The laptop keyboard can comprise a laptop (notebook) 104 with an optional laptop display screen 106, such as a liquid crystal display (LED) screen, e.g. an active matrix screen or passive matrix screen. The laptop keyboard has an interior with a remote control-keyboard circuit 108 on a substrate 110, such as a circuit board or computer chip. When one of the keys or button on the keyboard is pressed, a signal will be generated and emitted from the laptop keyboard which will be transmitted to the electronic circuit of the slot machine via wires 102 to remotely actuate and control the slot machine.

In the preferred form, the slot machine has a bill receiving slot 112 (FIG. 1) to receive paper currency, such as, one dollar bill, five dollar bill, ten dollar bill, fifty dollar bill, one hundred dollar bill, etc., in order to activate the game. The slot machine can further have a card slot to receive a credit card or debit card to activate the game. Instead of receiving a coin payout, the player can elect to receive payment or credit on the player's credit card or debit card.

The gaming machine preferably is a reel-type slot machine, with three mechanical symbol bearing reels or a video display thereof within a housing. The reels rotate in response to a player actuated pull handle after one or more coins are inserted into a coin input slot. The gaming machine can include an electronic control circuit 48 (FIG. 1) with a microprocessor 114 which stops each of the reels at random positions. As the reels come to a stop, different combinations of symbols for indicia will appeal adjacent to a win line. The microprocessor will determine if the combination of indicia stopped on the win line matches one of a number of predetermined winning combinations. If a match is found, a win occurs and the microprocessor generates a pay signal, which can cause a coin hopper to payout, through a payout chute, a specified number of coins or tokens, or increment a credit counter, or provide a signal to an attendant to provide the payout.

The number of coins dispensed for a win is generally controlled in relation to the odds that a particular combination will occur and the number of coins inserted by the player. The number of coins dispensed for a particular winning combination of symbols can be determined by a pay schedule 116 (FIG. 1). A number of different of pay schedules 116–118 can be provided, each of which may be dynamically selected during operation of the slot machine. These schedules can be displayed in a top glass portion of the slot machine. Other pay schedules 120 can be displayed in the front or belly glass portion of the slot machine.

The microprocessor in the slot machine can be a Motorola 6800 processor available from Motorola Corporation in Illinois. The microprocessor can control the operation of the slot machine in accordance with programs and data stored in its digital memory such as with an EPROM and a RAM. The EPROM and the RAM can be coupled to the microprocessor in the slot machine by an address bus and a data bus. To preserve data in the event of a power failure, the RAM can be coupled to a battery backup circuit. The microprocessor can also be coupled via the address bus and a data bus to various input sensors and other peripherals in the slot machine through an input/output board. The RAM can provide storage location for an event counter, the contents of which can be successively incremented or decremented by the microprocessor, and a progressive meter.

The microprocessor in the slot machine can be electronically operatively connected via the input/output board to: a bell that is responsive to a bell signal which causes the bell to emit an audible sound. The microprocessor in the slot machine can also be operatively connected to the handle which generates a handle signal that indicates when the handle is pulled. The microprocessor can further be operatively connected to a coin hopper that is responsive to a pay signal which causes the coin hopper to dispense a designated number of coins. The microprocessor can also be operatively connected to a coin acceptor that generates a coin signal which indicates the number of coins inserted by a player into the coin slot.

In the slot machine, the microprocessor can control each of the reels through a reel control mechanism. The reel control mechanism can include a stepper motor or the like for each of the reels to start and stop the rotation of the reels in accordance with signals from the microprocessor. The reel control mechanism can also be coupled to an input/output board which is responsive to the microprocessor for selecting a particular one of the stepper motor controls to receive control data from a data bus. Alternatively, the game control microprocessor can display a video representations of physical reels on a display screen comprising a video monitor.

In the slot machine, the microprocessor can randomly select stop positions for each of the reels. Once the stop positions have been selected, the microprocessor can determine whether a win condition is present and, if so, how much the payout should be. After the reel stops have been selected, the microprocessor can access a particular pay schedule for a set of pay schedules, which can be stored in an EPROM.

In operation, the microprocessor can select one of the pay schedules in the columns by examining the coin signal and the contents of an event counter. If a player inserts only one coin into the coin slot prior to pulling the handle, then the microprocessor can select the pay schedule in one column. If the player inserts two coins, the microprocessor selects the pay schedule in another column. If the player inserts three coins, the microprocessor selects the pay schedule in a further column. Each of the schedules in the columns can be assigned to a range of values which the event counter may contain. The microprocessor can select the pay schedule whose assigned range includes the current value of the contents of the event counter.

The event counter can contain an initial value when initialized and can be incremented by the microprocessor upon the occurrence of certain events. Events which cause the counter to be incremented can include the insertion of a coin or the occurrence of certain positions of reels or symbol centered on the win line of the center reel. Each time the microprocessor increments the event counter, it can cause the bell to ring by generating a bell signal resulting in an audible indication to the player that the progression has advanced. The event counter can be reinitialized in a preprogrammed manner. The selection of pay schedules can be a function of the contents of the event counter.

The set of pay schedules in the columns can be ranked in ascending order of payout amounts. The pay schedule in the column with the progressive payout amount can be ranked highest. The assignment of numerical ranges can be correlated with the rank so that as the event counter is incremented, the microprocessor progressively selects the pay schedule in rank order.

During normal gaming machine operation, the microprocessor after selecting the stop positions of reels, determines which symbols on the reels are stopped at the win line and searches the column in the pay table for a winning combination of symbols. If a match is located, the microprocessor can determine a pay amount corresponding to the winning combination. The microprocessor can then generate a pay signal through an input/output chip which causes a coin hopper to pay out through the coin chute that number of coins equivalent to the selected payout amount.

One of the pay schedules can contain a variable payout amount for a particular winning combination. This variable payout amount can be referred to as the progressive payout amount. Other variable payout amounts can be provided. The progressive payout amount can be listed in the highest ranked pay schedule and can be paid in response to the highest paying winning combination. The progressive payout amount can be generated by a progressive meter in a memory location in RAM which contains the current value of progressive payout amount. The contents of the progressive meter can be periodically incremented by a predetermined amount on the occurrence of a predetermined event. The progressive meter can be initialized at a preselected value and can be incremented by a predetermined amount such as a dollar and the occurrence of certain stopped positions on the reels. The progressive meter can be reset upon predetermined events. Typically, the progressive meter is reset when the microprocessor generates a pay signal to pay a jackpot.

The slot machine can include three symbol bearing reels which are rotatably mounted on a common axis. The slot machine preferably includes a lever which provide handle that a player can pull to initiate a game. The slot machine also has a coin intake slot, through which the player inserts coins, and a coin hopper which stores coins inside the slot machine. A coin tray is provided to dispense and collect a player's winnings.

The reels are preferably identical, although they may vary in terms of the number and placement of symbols, if desired. Symbols are located on the periphery of each reel. Each reel has many slot positions. A win line is positioned on the display window, so that when the reels are at rest, at least one symbol for each reel is visually aligned with the win line. Each reel's final resting position can be at a predetermined at a discreet reel stop position. At each reel's top or front position, a particular part of the reel's periphery, such as a symbol or a blank space, is displayed at the win line, so that each reel stop positioned is associated with a particular symbol or blank.

The microprocessor can control the slot machine in accordance with programs and data stored in a memory. The memory can be coupled to the microprocessor by address and data lines or a bus. A game outcome logic circuit can also be connected to the microprocessor. An input-output controller in the slot machine can provide an interface between the microprocessor and various sensors. One sensor can generates a handle signal to indicate when the player has pulled the handle. Another sensor can generate a coin-input signal to indicate when the player has inserted coins into the coin slot. An input-output controller can cooperate with a sensor to generate a control signal to actuate the coin hopper to discharge coins into the tray upon winning.

Game play is initiated when the microprocessor detects that a player has inserted a coin and pulled the handle. The microprocessor can query a game outcome logic circuit to determine a randomly selected reel stop position for at least one of the reels. The combination of selected reel stops is the game outcome. The microprocessor can signal the selected reel stops positions to a reel control mechanism. The reel control mechanism call set the reels into motion with a motor. The reels are allowed to spin for a short time, and then are stopped at the selected reel stop positions. Symbols on each of the reels correspond to the selected reel stops and are displayed at the win line. The game results can be determined by microprocessors in cooperation with a game outcome logic circuit.

Instead of mechanical reels, a video display can be used. The video system is comparable to the mechanical system, except that in place of the reel control mechanism, a video control interface circuit can be provided. The interface circuit allows the microprocessor to generate video display of the game result displayed on a video screen. The video display is a representation of spinning reels. Other suitable displays and symbols can be provided.

In the interior housing of the slot machine, there are three or more reels comprising a variable display including a first reel, a second reel, and a third reel. The reels each have an outer peripheral surface which is divided into sections. The reels each have different symbols, such as a star, bar, lemon, etc. in the different sections of the reel. One to three symbols per reel can be viewed through the display windows in the front face of the housing.

One to three coins or more can be deposited to play the slot machine. Upon input of a coin into a coin entry slot, a single win line is made active. The active state of the win line can be signaled to a player by lighting of a lamp or light, corresponding to the win line in the display window of the housing. In the front of the housing, there can also be a credit button and a coin entry button. If the player depresses the credit button, the number of coins to the player's credit can be displayed on a credit number display.

When the player pulls a start lever comprising the pull handle, after inserting coins into the coin input slot, the reels rotate so that display symbols on the reels rotate. When a predetermined time period has elapsed after the reels have rotated, the reel can be stopped in a sequential manner. If a combination of symbols stopped at the will line corresponds to a winning combination, payout of coins will be dispensed into the payout tray or a credit will be displayed, as per the player's option.

One or more coins can be inserted into a slot in a coin acceptor mechanism of the slot machine. After the microprocessor has determined that the coin or coins are valid, a coin-in switch can activate the circuit to release a handle-lockout mechanism which can also be or include a play button switch. The pull handle comprising, a lever or crank is then enabled. The pull handle can be rotated or the push button depressed. This effects rotation of the symbol bearing annular wheels or reels. As previously indicated, each of the reels, has indicia or symbols, such as bars, cherries, plums, etc. positioned about its periphery. There can be three or more such reels in the form of annular shells rotatable about a common axis. Each reel can have many symbols positioned uniformly about its periphery. The initial or zero position of each reel can be sensed by position sensors which can be an optical-sensors. The rotation of the reels can be stopped at positions effected by the results of the game played so as to display combinations of indicia or symbols corresponding to the game results.

Scoring control and pay-out circuitry can be provided to actuate a motor to discharge coins from a hopper if the game is a winner. Coins corresponding to the pay-out can be discharged from the pay-out hopper through a coin pay-out mechanism to the pay-out tray at the front of the slot machine. The level of coins in the hopper can be sensed by a hopper coin detector. When the hopper is full coins, input into the slot can be diverted by a mechanical diverter to a drop box.

Control of the functions of the slot machine can be through a central processing unit (CPU), such a computer, microprocessor, computer chip, or logic control board. The CPU can produce a random number generator for each reel and can select a number corresponding to a reel position for each reel. The random members generated can actuate a brake mechanism through circuitry to stop each reel in order. The CPU can also control the releasing of the handle lockout mechanism when the coin-in switch has been triggered and the coin has been accepted. The CPU can further control a coin lockout device and can control the starting and stopping of the reels. The CPU also randomly determines winning or losing of the game and the disbursement of coins if there is a winner.

The read only program memory comprising the EPROM can have 64 K or more capacity, such as a Motorola 27C512 EPROM available from Motorola Corporation of Illinois. The random access memory, i.e. RAM can be of 32 K or more capacity, such as a Dallas DS123OY available from Dallas SemiConductor, Inc. of Dallas, Tex. An interface microprocessor can be used which can comprise a single chip microprocessor containing an EPROM program memory and RAM A Phillips 87C652 microprocessor available from Phillips Electronics. A hopper driver single chip microcomputer can be used which comprises a hopper control and payout logic, to control the hopper motor in order to pay out coins when a winning combination has been determined. A Microchip PIC 16C54 microprocessor chip manufactured by Microchip technology, Inc. of Chandler, Arizona is an example of a single chip microprocessor which can provide a hopper drive microcomputer. The number of coins which have been paid can determine by a sensor which provides one or more pulses to an input line of the microprocessor. The microprocessor can communicate through a bi-directional serial communications link to a primary microcomputer so that it receives signals concerning the number of coins to be paid when there is a win. After the payout logic and hopper control has generated the payout through the hopper motor, the information as to the payout can be communicated to the primary microcomputer.

The primary microcomputer or microprocessor can also communicate with reel drivers. Each reel driver controlled microcomputer can comprise a single chip microprocessor, such as a Microchip PIC 16C54 available from Microchip Technology, Inc. of Arizona. Each reel drivers can also be connected to a motor associated with each of the reels. Each motor can be a stepper motor and can be located within the annulus of its respective reel.

The microprocessor can determine the positions of the reels. This information is processed and transmitted by the microprocessor to set the initial positions of the reels. The primary microcomputer communicates with all of the microprocessors associated with the various reel drivers and can provide a command to start all reels in motion after the microprocessor has determined that the game is to commence by either rotation of the pull handle or a depression of the push button. After the primary microprocessor has calculated a random number and determines whether a winning game or losing game has resulted, and has determined an appropriate reel combination to display, the information can be communicated to the respective microprocessor of each reel driver which counts the steps that the motor has made, i.e., the number of pulses received, and stops the rotation of the motor in accordance with the information received from the primary microprocessor. This can be accomplished in sequence so that the primary microprocessor awaits information from each motor driver in succession to report that the associated reel has stopped successfully and then the primary microprocessor proceeds to address the subsequent drivers.

It is to be understood that rather than utilizing a primary microprocessor in conjunction with the other microprocessors, a single microprocessor or CPU can be utilized to control and operate the entire gaming system and slot machine.

It is to be further understood that while FIGS. 1–3 illustrate payout and dispensing of coins which are overflowing out of the coin-output receptacle, e.g. tray, the coin-output receptacle can be deeper to receive and collect all coins that are paid out (i.e. dispensed). Furthermore, a coin control sensor or mechanism can be provided to prevent overflow of coins, so that the dispensed coins need to be removed by the customer before further coins are dispensed.

As previously indicated, gaming machines, e.g. slot machines, are games of chance. The traditional mechanical slot machine includes three or four symbol-bearing reels rotatably mounted on a common axis. The symbols are located on the peripheries of the reels, and are typically pictures of bells, bars, fruit, etc. There can also be blank positions or symbols, which comprise the portions of the reels' peripheries in between the picture symbols.

The reels are placed behind a transparent plastic or glass plate display window and are oriented so that their symbol-bearing peripheries face the player. A horizontal win line is etched or painted on the display window so that when the reels are at rest, one symbol for each reel is visually associated with the win line. A single win line defines the symbol that produce a single game outcome. In a three reel slot machine having a single horizontal win line, the win line defines the three symbols that determine the game outcome. The slot machine can also make use of the fact that more than one symbol for each reel may be visible to the player and therefore leave multiple win lines, including both horizontal and diagonal lines. In a three reel slot machine having three horizontal and two diagonal win lines, five groups of three symbols define five game outcomes, i.e., the player has five different ways to win.

To play the slot machine, the player spins the reels by: (1) pulling a handle, or (2) pushing the play or spin button on the slot machine, or (3) by pushing a play or spin button or key on the remote control. As the reels spin, a series or progression of symbols are displayed along the win line. After a brief period of spinning, each of the reels comes to rest at discrete reel stop positions. At each reel stop position, a particular part of the reel's periphery, i.e., a symbol, is displayed at the win line. The game outcome is the particular combination of symbols displayed at the win line.

In electronic machines, the reels are controlled by a CPU,. Such as a computer or microprocessor, and there is no mechanical linkage between the handle and the reels. Instead, when the user pulls the handle, or presses the play or spin button on the slot machine, or presses the play or spin button or key on the remote control, the computer or microprocessor randomly selects the reel stop positions for each of the reels, and then sets the reels into motion. The reels are allowed to spin for a short time, and then are stopped at the selected reel stop positions. In effect, the game outcome is determined by the computer or microprocessor comprising the CPU.

As indicated above, in some slot machines, the reels are eliminated altogether, and the game outcome is displayed on a video screen. The video display is often a representation or facsimile of spinning reels, to preserve the charm and excitement of the traditional slot machine. To simulate the effect of a spinning reel, the video screen displays a series or progression of symbols, which appear to move past a win line.

Among the many advantages of the gaming systems with the remote controls of this invention are:

1. Superior performance.
2. Excellent adaptability to attain more convenient locations to operate slot machines for repeat players, senior citizens and handicap persons.
3. Super ability to change the height and location from which a player plays a slot machine.
4. Greater entertainment.

5. Easier for senior citizens and handicap persons ot use remote controls for slot machines.
6. Ease of play.
7. Improved performance.
8. User-friendly.
9. Simple to operate.
10. Handicap accessible.
11. Faster play.
12. Affordable.
13. Convenient.
14. Comfortable
15. Fun.
16. Exciting.
17. Attractive.
18. Reliable.
19. Safe.
20. Economical.
21. Efficient.
22. Effective.

Although embodiments of the invention have been shown and described, it is to be understood that various modifications and substitutions, as well as rearrangements of parts, components, and process steps, can be made by these skilled in the art, departing from the novel spirit and scope of this invention.

What is claimed is:

1. A gaming system, comprising:

a slot machine having a display for viewing a game, a coin-input slot for receiving a coin to activate the game, at least one button for playing the game, and a coin-output receptacle for receiving coins upon payout of the game; and a portable controller operatively associated with and spaced from said slot machine for remotely playing the game in said slot machine, said portable controller having a card slot for receiving a credit card or debit card to activate the game in said slot machine, and said portable controller having a cashout button for a person playing the game to push for remotely discharging collected coins in said slot machine into said coin-output receptacle of said slot machine upon payout of the game.

2. A gaming system in accordance with claim 1 wherein said controller comprises a moveable laptop keyboard.

3. A gaming system in accordance with claim 1 including a cable or wire connecting said controller to said slot machine.

4. A gaming system in accordance with claim 1 wherein said controller comprises a battery-operated hand-held remote control.

5. A gaming system, comprising:

a slot machine having a housing and a display screen for displaying a game, said game comprising at least three reels or simulated reels, a microprocessor coupled to an electronic circuit for affecting rotation or simulating the rotation of said reels, a mechanical lever comprising a manual pull handle extending laterally outwardly of said housing and connected to said electronic circuit to spin said reels, a coin-input slot with a coin chute in said housing for receiving at least one coin to activate the game, a coin-output receptacle comprising a trough, tray, or bucket in a portion of said housing for receiving coins upon payout of the game, and at least one play button connected to said circuit for spinning said reels; and a portable hand-held remote control spaced away from and manually moveable about a front portion of said slot machine, said portable hand-held remote control having at least one button for emitting a signal to said electronic circuit in said slot machine to spin said reels from a location spaced from said slot machine, and said portable hand-held remote control having a card slot for receiving a credit card or debit card to activate the game in said slot machine.

6. A gaming system in accordance with claim 5 wherein said portable hand-held remote control is hard wired to said slot machine by a wire or cable extending between and connecting said remote control to said electronic circuitry in said slot machine.

7. A gaming system in accordance with claim 5 wherein said portable hand-held remote control comprises a battery operated remote control.

8. A gaming system in accordance with claim 5 wherein:

said display screen has a single or multiple pay lines;

said reels have indicia comprising symbols selected from the group consisting of bells, cherries, 7's, stars, bars, plums, oranges, lemons, watermelons, wild symbols, bonus symbols, jackpot multipliers, and combinations thereof, said coin is selected from the group consisting of a nickel, dime, quarter, half-dollar, token, or another minted coin representing legal tender of a government;

said slot machine includes a device selected from the group consisting of a microprocessor, computer chip, or circuit board, for containing at least part of said electronic circuit;

said slot machine has at least one indicator light extending above said housing and connected to said circuitry for signaling an alarm; and said portable hand-held remote control has a credit button for displaying credits on said display screen of said slot machine; and said portable hand-held remote control has a multiple spin button operatively connected to said electronic circuit of said slot machine for spinning said reels of said slot machine from a location spaced from said slot machine for continuous games until the credits are depleted.

9. A gaming system in accordance with claim 5 wherein said portable hand-held remote control has an array of manually depressible buttons including a payout button for remotely discharging coins from said chute into said coin-output receptacle of said slot machine upon winning and payout of the game.

* * * * *